US005362021A

United States Patent [19]

Phillips

[11] Patent Number: 5,362,021

[45] Date of Patent: Nov. 8, 1994

[54] MULTI-ADJUSTABLE SURGICAL TRAY APPARATUS

[75] Inventor: James L. Phillips, Cary, N.C.

[73] Assignee: Phillips Medical Group, Inc., Cary, N.C.

[21] Appl. No.: 881,042

[22] Filed: May 11, 1992

[51] Int. Cl.[5] ..... A61G 13/10

[52] U.S. Cl. ..... 248/225.31; 248/124; 5/507.1; 5/658

[58] Field of Search ..... 248/225.31, 124, 125, 248/231.7; 5/503.1, 505.1, 507.1, 600, 658

[56] References Cited

U.S. PATENT DOCUMENTS 372,288 11/1887 Bailey ..... 5/507.1

4,113,218 9/1978 Linder ..... 248/124 X

*Primary Examiner*—Richard K. Seidel
*Assistant Examiner*—Raymond D. Woods
*Attorney, Agent, or Firm*—Gordon W. Hueschen

[57] ABSTRACT

A multi-adjustable surgical table, shelf, or tray apparatus, adapted to be releasably secured to the bed rail of an operating table, which has a fixed first tray or shelf and a multi-adjustable second tray or shelf pivotally-connected thereto, for the placement thereon of tools and materials of an operating surgeon in a convenient location for immediate access during the course of an operation. In a most preferred embodiment, both trays or shelves comprise transparent sheetform material as their major planar surface.

12 Claims, 6 Drawing Sheets

10
20
S
R1
K
VL
40
60
65
MAM
K1
K2
R2
50
S
11
15
K3
30
13

10
CL
20
R1
P1
VL
40
4
60
K
65
K1
MAM
70
90
R2
K2
50
4
58
K3
30

FIG. 10
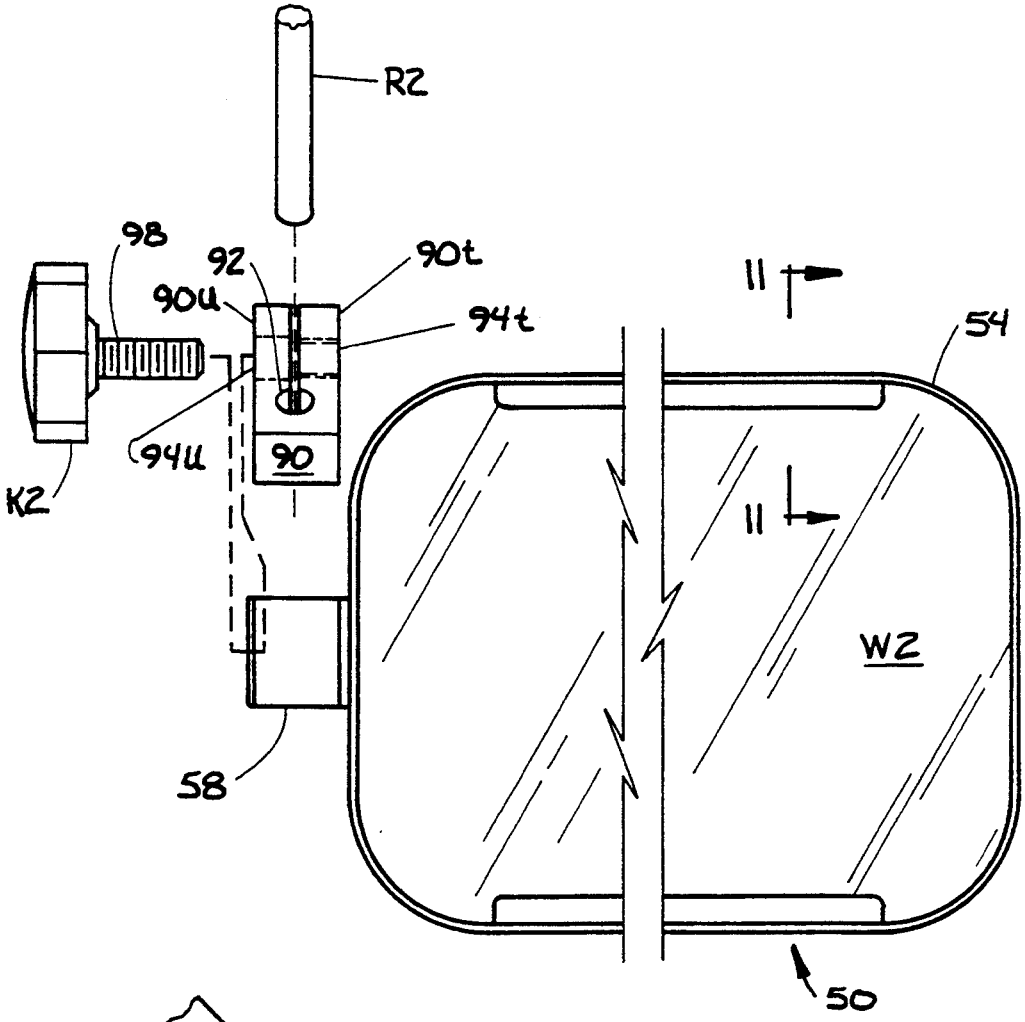
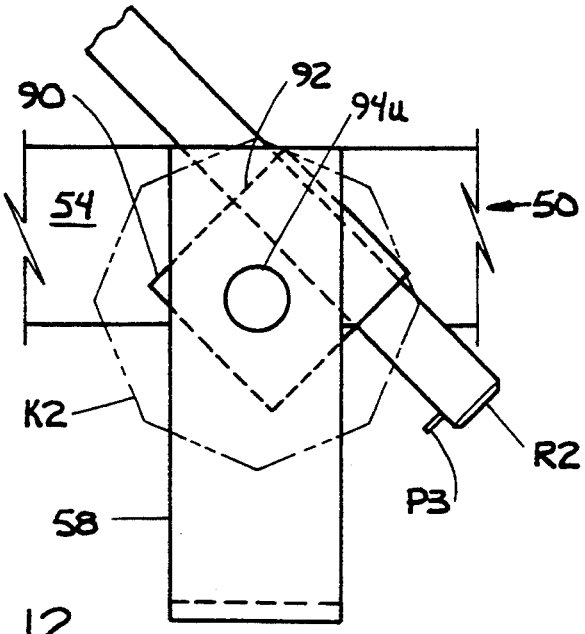
FIG. 12
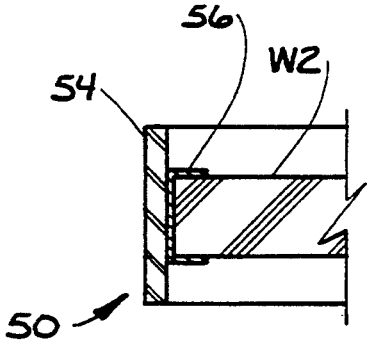
FIG. 11

MULTI-ADJUSTABLE SURGICAL TRAY APPARATUS

BACKGROUND OF THE INVENTION

FIELD OF THE INVENTION AND PRIOR ART

The present invention relates to a multi-adjustable surgical table, shelf, or tray apparatus, which is adapted to be releasably secured to the bed rail of an operating table for vertical and horizontal adjustment, which has a fixed upper tray or shelf and a multi-adjustable lower tray or shelf, all for the purpose of assisting the surgeon during the course of an operation by permitting the placement of the tools and materials of the surgeon in the most adjacent and convenient location for immediate access during the course of an operation. In the most preferred embodiment, both trays or shelves comprise transparent sheet form material as their major planar surface, for maximum visibility of the patient area of greatest interest to the surgeon even when the surgical tray apparatus of the invention is in place and in use.

Surgical or ether screens have been in use in operating rooms in association with operating tables for years. Ordinarily, such a screen or support therefor is affixed to the operating table and appropriate sheets are draped over the support to provide an unobstructed area for the surgeon on the one side of the screen and for the anesthesiologist on the other side of the screen. For the operating surgeon, the accessibility of the necessary surgical tools, implements, or materials has been a problem generally solved by providing the same on a "set-up" table adjacent the operating table and having the same provided to the surgeon by a nurse trained in surgery. Although such practice will undoubtedly continue, the availability of surgical implements and materials at a readily-accessible location adjacent the area of the operation in progress by means of the present invention is designed at least partly to alleviate the hardship of the surgeon's role in the operating procedure, to make all implements and materials more readily accessible, and to accomplish these desirable ends without the introduction of objects into the area of the operation which would be of an interfering or objectionable nature, for which reason the multi-adjustable surgical table of the present invention is adapted to take the place of the usual ether or surgical screen and to provide, in addition thereto, a plurality of surgical trays or shelves, one of which is capable of multiple adjustments so as to fit the needs and convenience of the operating surgeon in any particular case.

OBJECTS OF THE INVENTION

It is an object of the present invention to provide a multi-adjustable surgical table of the type described and which may, in addition to serving as a multi-adjustable surgical table, also serve as a conventional ether or surgical screen. Another object is the provision of such a device which is horizontally adjustable along the bed rail of an operating table as well as vertically upwardly and downwardly adjustable to bring the shelves, tables, or trays thereof into and out of proximity to a patient on the operating table. A further object is the provision of such a device having one fixed shelf or table as well as a multi-adjustable depending shelf, table, or tray. Still another object of the invention is the provision of such a device wherein the tables, shelves, or trays incorporate a transparent sheet form material as their major planar surface, preferably of an unbreakable nature, so as to minimize obstruction of the surgeon's visibility during the surgical procedure, even when both shelves, tables, or trays are in use during the operation. An additional object of the invention is the provision of such a device wherein the secondary or depending shelf or tray is adjustable in all directions so as to enable the surgeon to place the same into precisely the position of greatest interest for the particular operative procedure being conducted at the time. Other objects will be obvious to one skilled in the art and still other objects will become apparent as the description proceeds.

SUMMARY OF THE INVENTION

The invention, then, comprises the following, inter alia, singly or in combination:

A multi-adjustable surgical table comprising the following elements:

a generally U-shaped major frame having essentially vertically-extending legs adapted to be releasably secured to a bed rail of an operating table and which may, if desired, serve as a conventional ether screen frame;

a pair of bed rail clamps adapted to adjustably and releasably secure said legs to said bed rail for both vertical and horizontal adjustment thereon;

an upper shelf fixed in position between said essentially vertically-extending legs and extending outwardly therefrom in a plane essentially normal thereto so as to be adapted to be essentially parallel to the plane of an operating table when said apparatus is in place thereon;

a lower outwardly-extending shelf pivotally connected by adjustable mounting and adjustment means to a vertical leg of said major frame or to said upper outwardly-extending shelf;

said lower shelf being adjustable vertically, horizontally, and rotatively, and being thereby adapted to be placed in any desired position with relation to a patient on said operating table; such an apparatus wherein both shelves comprise a transparent sheet form material as a major planar segment thereof; such an apparatus wherein said sheet form material is essentially unbreakable; such an apparatus wherein said sheet form material is transparent plastic; such an apparatus wherein said sheet form material is transparent Plexiglass® (acrylic resin, e.g., methylmethacrylate resin); such an apparatus wherein said lower shelf is pivotally connected to a frame of said upper shelf; such an apparatus wherein said lower shelf is pivotally connected to a vertical leg of said major frame; such an apparatus wherein said upper and lower shelves comprise a sheetform material as a major planar surface thereof which is held in place within an outer frame of said shelf by means of a generally U-shaped channel; such an apparatus wherein said major frame comprises flat bar stock and said bed rail clamps comprise a correspondingly dimensioned rectangular aperture for adjustment of said vertical legs therein and a horizontal aperture for straddling said bed rail and means for releasably securing said clamps with included leg and bed rail portions in any desired position; such an apparatus wherein said lower shelf is rotatably suspended by mounting and adjustment means comprising rods and clamp means, each clamp means comprising a bore adapted slidably to receive at least one of said rods and one of said clamp means comprising two bores adapted to receive two of said rods, each of said clamp means being provided with releasable securement means for securing said rods at any desired position within said bores, thus to enable said lower shelf to be positioned at any desired location with respect to a patient on said operating table; such an apparatus wherein said mounting and adjustment means comprises a releasably-securable pivot and location first clamp means and a first rod releasably secured in an aperture therein, a second rod, a releasably-securable second and double clamp means releasably securing said first rod and said second rod therein, and a releasably-securable third clamp means rotatively and releasably securable to a frame of said lower tray and releasably securing the lower end of said second rod in an aperture therein, each of said clamp means releasably securing said rods but permitting vertical, horizontal, and rotative adjustment of the rod or rods releasably secured thereby; such an apparatus wherein said releasably-securable second and double clamp means comprises split-ring clamp means and adjacent apertured block and U-grip clamp means and wherein said latter clamp means comprises draw bolt means which projects through said split-ring clamp means and is adapted to tighten said means simultaneously upon both rods; and finally, such an apparatus wherein said pivot and location clamp means comprises means for releasably securing said pivot and location clamp means in any desired angular position and means for releasably securing said first rod in any position of rotation therein; wherein said double clamp means comprises split ring clamp means and a two-part U-grip clamp block means mounted for rotation with respect to said split ring clamp means, one of said means being adapted to receive said first rod and the other of said means being adapted to receive said second rod, and said two-part clamp block means comprising draw bolt means which projects through said split-ring clamp means and is adapted to tighten said split ring clamp means and said two-part clamp means simultaneously on said rods at any position to which they may be adjusted angularly or rotatively; and wherein said third clamp means comprises split-block clamp means and means for tightening said split block clamp means about said second rod.

BRIEF DESCRIPTION OF THE DRAWINGS

FIG. 10 is a half-size top view of the lower adjustable table of the invention and its clamping device, partially exploded after taken along line 10—10 of FIG. 4.

FIG. 11 is a sectional view along line 11—11 of FIG. 10 or FIG. 13 showing a typical holding channel for the sheetform central major planar section of both the top fixed table or shelf and the lower adjustable table or shelf taken along line 12—12 of FIG. 3.

FIG. 12 is a full-scale side view of the clamping device for the lower adjustable table or shelf, with the locking knob and clamping block assembly shown exploded in FIG. 10 being shown in phantom lines.

DETAILED DESCRIPTION OF A PREFERRED EMBODIMENT

Figure 1:
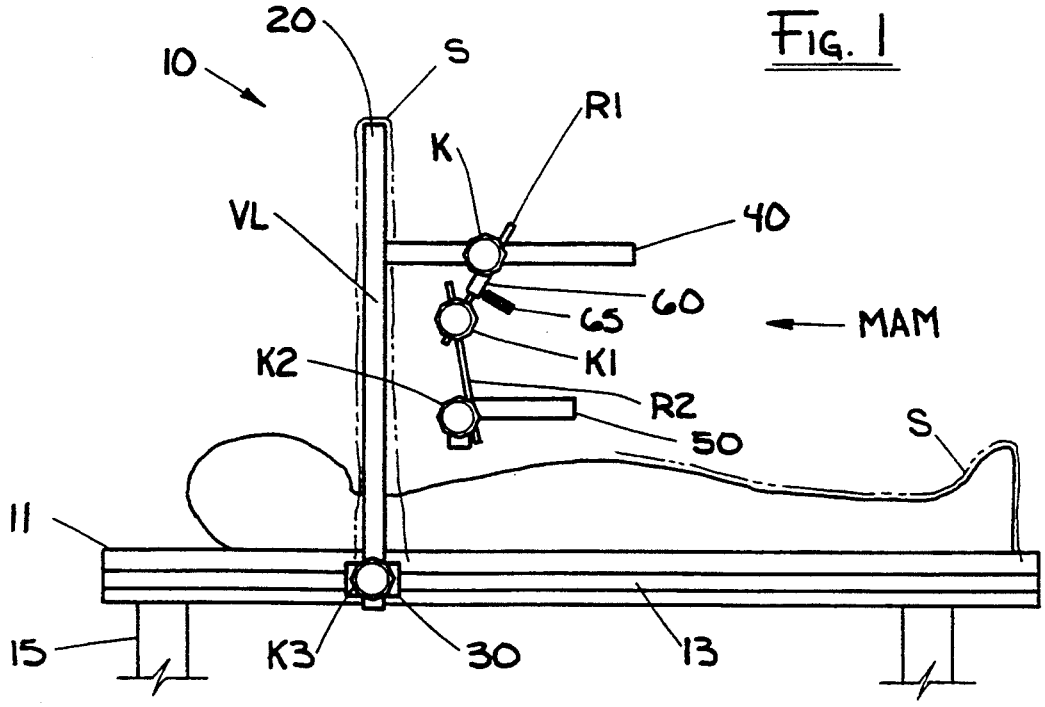
FIG. 1 is a side or face view showing generally the surgical table of the invention mounted on the horizontal rail of an operating table and showing the depending secondary or adjustable table in position above a patient.

The invention will be more readily understood by reference to the drawings hereof, wherein all of the parts are numbered and the same or similar numbers or letters are employed throughout to refer to the same or similar elements and structures.

Referring now to the drawings:

FIG. 1 shows the general layout of the invention and shows the surgical table of the invention generally at 10, mounted upon an operating table 11 having a bed rail 13 and supported by any suitable support means 15 in accord with conventional operating table structure. A patient is outlined lying prone on the operating table and the usual sheets and ether screen S, partially covering the patient and draped over main frame 20, are shown in shadow lines.

Main frame 20 is constructed of flat bar stock and is vertically disposed with respect to the operating table 11 and supported on the bed rail 13 thereof by means of bed rail clamp 30 having offset vertical and horizontal apertures and releasably secured thereto by means of locking knob K3.

Figure 2:
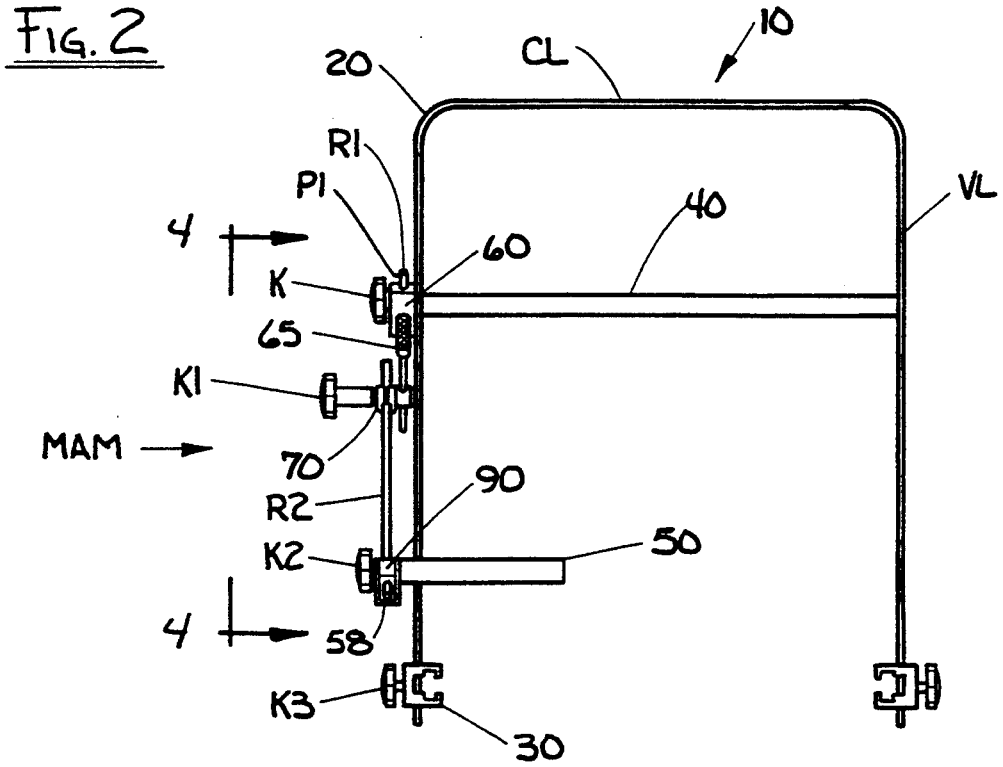
FIG. 2 is a front view of the surgical table of the invention.
Figure 13:
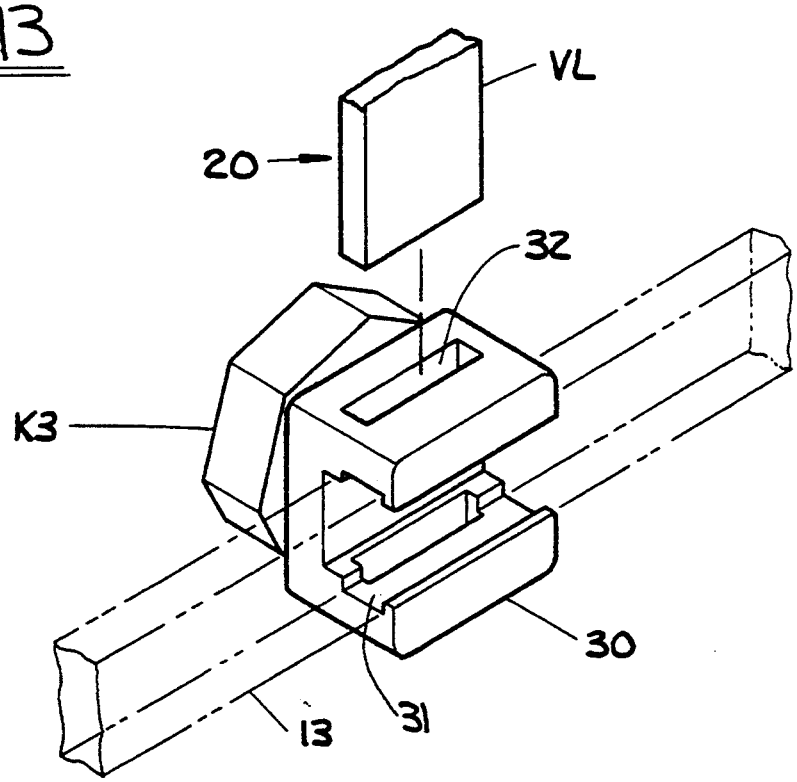
FIG. 13 is an isometric view of the lower and dual-acting clamping device for securing the surgical table of the invention to the bed rail of the operating table and for horizontal adjustment as well as vertical adjustment with respect to the operating table.

As shown in FIG. 2 and best shown in FIG. 13, bed rail clamp 30 also receives the lower end of vertical leg VL of main frame 20 in rectangular vertical slot 32 and, by means of rotatable locking knob K3 with attached threaded bolt and corresponding threaded aperture in vertical wall of clamp 30 (said bolt and aperture not being shown) releasably secures lower vertical leg VL within slot 32 for any desired vertical elevation of main frame 20 above operating table 11, as well as at any desired horizontal position with respect to the operating table 11 by virtue of its horizontal adjustability along bed rail 13 by means of the horizontal aperture 31 in bed rail clamp 30 and as also simultaneously and releasably secured in any such horizontal position all by a simple turn of the locking knob K3.

Figure 14:
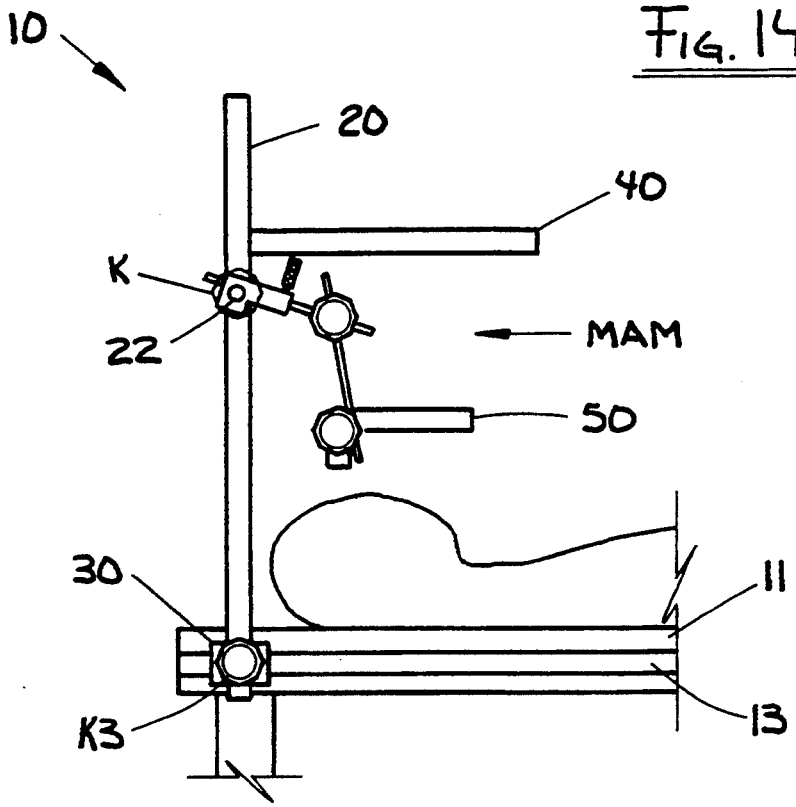
FIG. 14 shows both an alternate horizontal location of the surgical table of the invention and an alternate mounting position for the lower table mounting and adjustment means, namely, upon a vertical leg of the major frame of the surgical table rather than upon a frame of the upper fixed table.

In FIG. 14, the mounting of lower tray 50 is also shown in an alternate position, i.e., on vertical leg VL of main frame 20, as well as the horizontal location of main frame 20, and the relative position of lower tray 50 with respect to the body of a patient on the operating table 11. As can be seen from FIG. 14, the horizontal position of frame 20 with respect to the operating table 11 may be either above the head of a patient lying prone on operating table 11 or below the head of a patient as shown in FIG. 1.

Figure 15:
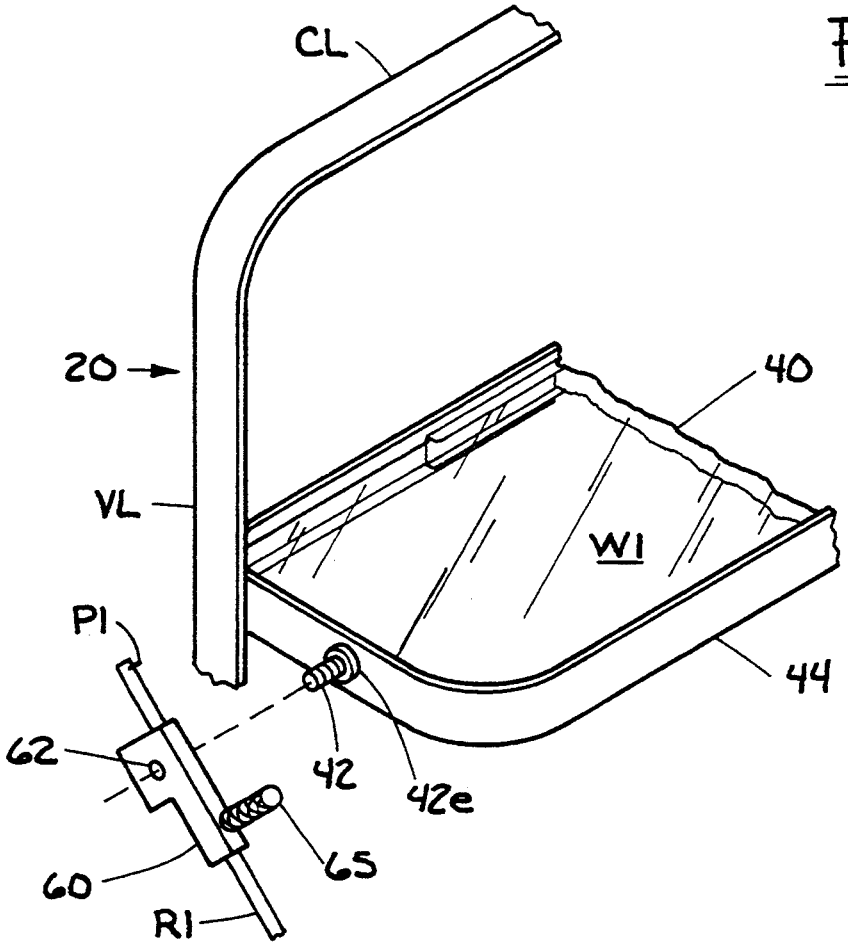
FIGS. 15 and 16 show alternative mounting means for mounting of the upper pivot and location block (of the mounting and adjustment means for the lower adjustable table) to either a frame of the upper fixed table or shelf (FIG. 15) or to a vertical leg of the major frame for the entire device (FIG. 16).
Figure 16:
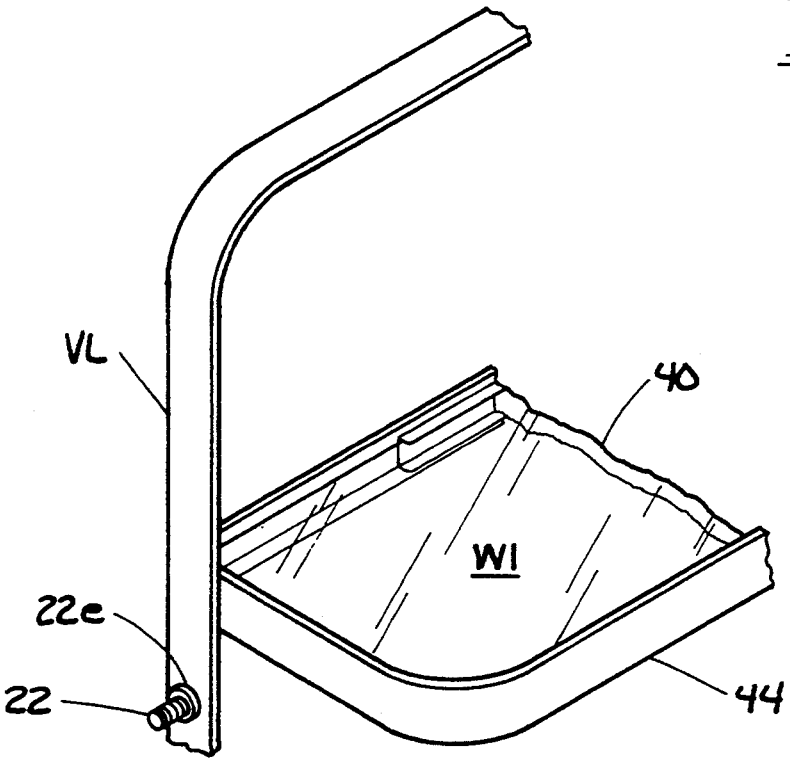

Extending normally from main frame 20, which has a generally U-shaped configuration, comprising vertical legs VL and upper cross leg CL, so as to provide a vertical leg VL on each side of the operating table, is upper fixed table, shelf, or tray 40 and, suspended beneath upper tray 40 is lower, secondary, or auxiliary tray 50, depending either from frame 44 of upper tray 40 or from vertical leg VL of main frame 20, as shown in FIGS. 15 and 16, by means of mounting stud 42 or 22, respectively, each having an enlarged portion **42*e* and 22*e*, respectively, the mounting being essentially as shown in FIGS. 1 and 14**, respectively.

Figure 4:
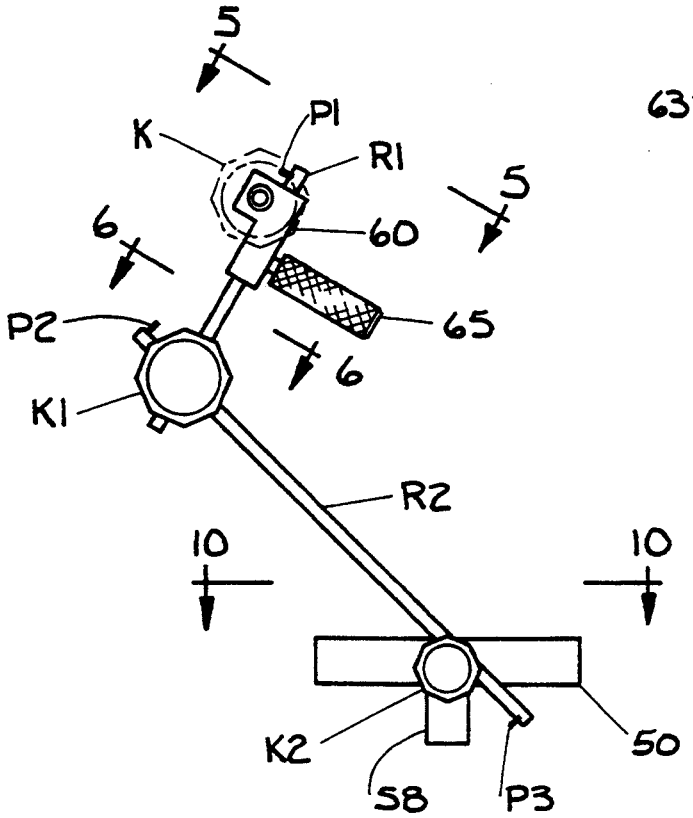
FIG. 4 is an enlarged side view of the depending adjustable table and the mounting and adjustment means therefor, taken along the line of 4—4 of FIG. 2.

Lower tray 50 is in any case supported by mounting and adjustment means MAM, generally shown in FIGS. 1 and 14 and more specifically shown in FIG. 4. Wherever mounting and adjustment means MAM is suspended, whether from stud 42 or stud 22, it is suspended on stud 42 or 22 by means of pivotable pivot and location block 60, having aperture 62 therein which corresponds to mounting stud 42 or 62 and enlarged portion 63 which corresponds to enlarged stud portion **42*e* or 22*e*. Block 60 is held in place thereon by knob K having an internally-threaded post or bore which engages the threads of stud 42 or 22. Within pivot and location block 60 is located borehole 66 adapted to receive upper rod R1 having retaining pin P1 at an upper end portion thereof. Rod R1 is secured in borehole 66 of pivot and location block 60 by knurled locking device 65, the threaded portion 67 of which is received in a threaded borehole in block 60, for upward, downward, or rotative adjustment of rod R1 within borehole 66**.

Figure 6:
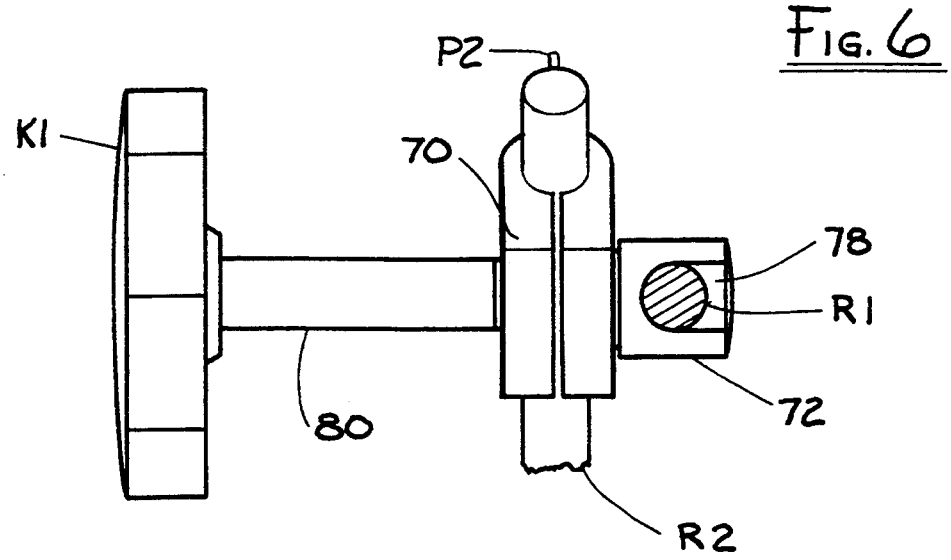
FIG. 6 is a section view taken along the line 6—6 of FIG. 4 just above the second locking knob.
Figure 7:
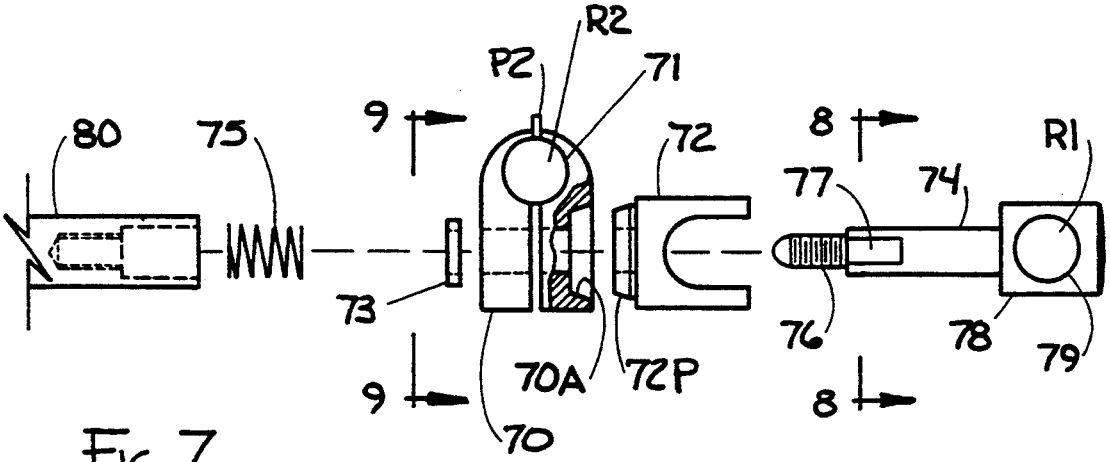
FIG. 7 is the same as FIG. 6 but exploded and partially broken away to show each part and the manner of its assembly into the clamping structure of FIG. 6.
Figure 9:
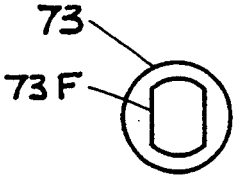
FIG. 9 is a face view of a washer from FIG. 7 with flats corresponding to the flats on the cylindrical stud or rod upon which the elements of FIG. 6 and FIG. 7 are assembled after take along line 9—9 of FIG. 7.
Figure 8:
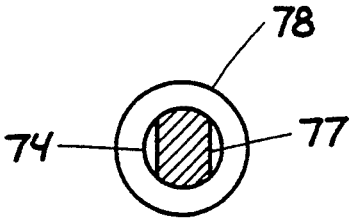
FIG. 8 is a sectional view along the line 8—8 of FIG. 7 showing the flats on the cylindrical rod or stud upon which the elements of FIG. 6 and FIG. 7 are assembled.

Toward the bottom of rod R1 is located split-ring clamp 70, with its adjacent dual clamp block 78, the entire assembly being shown in FIG. 6, in exploded view in FIG. 7, and with details thereof in FIGS. 8 and 9.

The upper portion of rod R2 is secured in corresponding aperture 71 provided in split-ring clamp 70, where it is retained in any desired horizontal, vertical, or rotative position by means of locking knob K1 and its internally threaded post 80, operating in conjunction with the other elements of this portion of the mounting and adjustment means MAM as shown in FIGS. 6 through 9. As seen from FIG. 6, secondary dual clamp block 78 is provided with aperture 79, corresponding to the cross-sectional dimensions of rod R1, wherein rod R1 is retained in any horizontal, vertical, or rotative position by means of retaining U-grip clamp block 72, within which clamp block 78 fits slidably, and which has a double (upper and lower) U-shaped indentation so as to provide a U-shaped aperture into which rod R1 disposed in borehole 79 of clamp block 78 can fit and be gripped snugly. Split-ring clamp 70 is advantageously provided with a shallow and advantageously tapered cylindrical recess 70A in a side wall thereof adapted to receive correspondingly-shaped protuberance 72P of retaining block 72 for freely-rotating engagement therein. Clamp block 78 is provided with cylindrical stud 74 having an outwardly-extending threaded screw portion 76, which is press fit into or integral with stud 74. The portion of stud 74 Just adjacent to screw portion 76 is provided with flats 77, shown in FIGS. 7 and 8. Washer 73, located at the opposite side of split-ring clamp 70, is also provided with corresponding flats 73F so that, upon insertion of clamping block 78 with rod R1 disposed in its corresponding borehole 79 into its corresponding retaining block 72, and upon insertion of stud 74 with its protruding threaded screw portion 76 through block 72 and split-ring clamp 70 via apertures provided and shown in shadow lines therein, and retention of the flats 77 by the flats 73F of washer 73 on the opposite side of split-ring clamp 70, disposition of spring 75 over the protruding portion of stud 74, and engagement of the threaded extension 76 within internally threaded post 80 of adjustment knob K1, the entire assembly is drawn into the closed condition shown in FIG. 6, with rod R2 releasably secured in any desired horizontal, vertical, or rotative position within aperture 71 of split-ring clamp 70 and with rod R1 disposed in aperture 79 of clamping block 78 and releasably secured in place therein by the outwardly extending arms of retaining block 72. Upon tightening internally-threaded post 80 by means of knob K1, rod R1 is also secured in any desired horizontal or vertical or rotative position within aperture 79 of clamping block 78, block 78 with cylindrical stud 74 and extension 76 acting as a draw bolt for such purpose. Although, as shown, both block 78 and retaining U-grip clamp block 72 are cylindrical in nature, block 78 fitting within cylindrical aperture in block 72, rectangular and other shaped blocks may be employed, so long as retaining block 72 is rotatable with respect to split-ring clamp 70.

Finally, at the lower extremity of rod R2, provided at its upper end with retaining pin P2 and at its lower end with retaining pin P3, is provided a further clamping block 90, releasably rotatively secured within U-shaped bracket 58, in turn secured at the top of its one U arm by welding or the like to frame 54 of lower tray 50. Clamping block 90 as shown is a split-block clamp, having on one side **90*u* an unthreaded horizontal bore 94*u* and on the other side 90*t* a threaded continuation 94*t* of the bore, as well as vertical unthreaded bore 92 therein for receiving the lower end of rod R2. As shown in FIGS. 11 and 12, with said clamping block 90 secured within U-shaped bracket 58 attached to frame 54 of lower tray 50, rod R2 extending through corresponding borehole 92 is adjustable vertically, horizontally, and rotatively within bore 92 and the tray 50 is accordingly rotatively maneuverable about rod R2, as well as angularly upon rotative adjustment of block 90 by means of bolt 98, securement of the rod R2 and tray 50 in any desired location and position being effected by means of knob K2 and its threaded bolt portion 98, which extends into and through the unthreaded aperture 94*u* in 90*u* and into the threaded aperture 94*t* in 90*t*, both portions of locking or clamp block 90, thereby to draw the segments 90***u* and 90*t* thereof into locking position with respect to rod R2, knob K2 and threaded bolt 98 again acting as a draw bolt to draw block segments 90*u* and 90*t* together.

Figure 3:
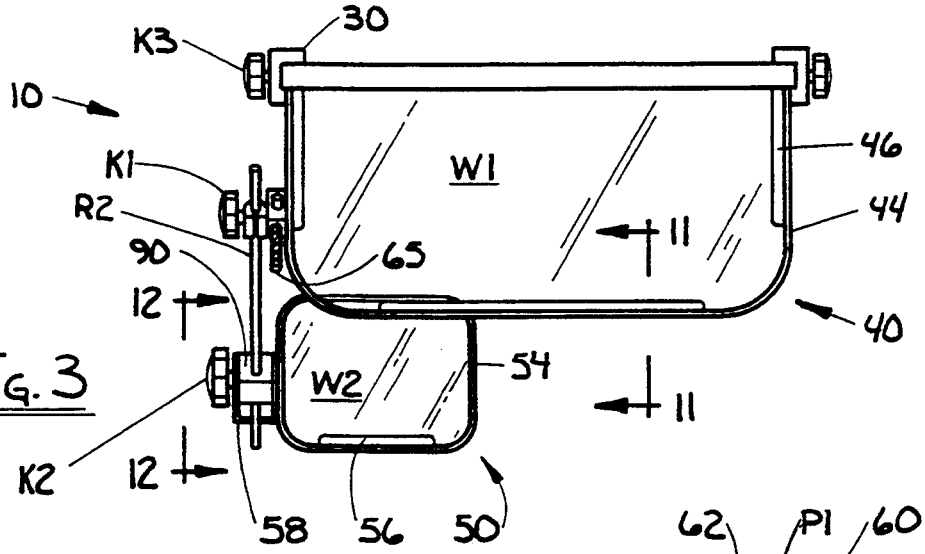
FIG. 3 is a top view of the surgical table of the invention with the depending adjustable table in position therebelow and with uppermost knob K removed.
Figure 5:
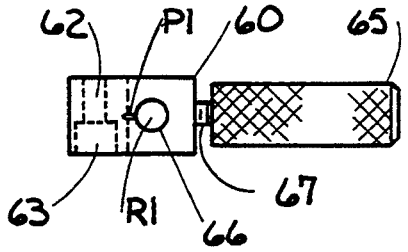
FIG. 5 is a top view looking down on the top portions of the adjustable table locking handle and pivot and location block taken along the lines 5—5 of FIG. 4.

From FIGS. 3, 10, and 11 can be seen the relative relation of the upper or fixed tray 40 and the lower and adjustable tray 50, as well as the preferred means for mounting the major planar sections thereof, as shown windows W1 and W2, within the outer frames 44 and 54, respectively, of trays 40 and 50. Mounting means in the form of inturned channels 56, secured to frame 54 of lower tray 50 by any suitable means, such as by welding, brazing, or adhesive, are particularly shown in cross section in FIG 11, with transparent window W2 being held fixedly within the arms of the generally U-shaped channel 56 in turn secured to the inner surface of outer frame 54 of lower tray 50.

As already stated, the major planar section of both trays 40 and 50 comprises major planar surfaces, as shown windows W1 and W2, which are preferably of transparent sheetform material and may be of glass or plastic, but in any event are preferably of an unbreakable nature, so that clear transparent plastic such as Plexiglas® or Lexan® (polycarbonate or resin) are especially suitable for maximum visibility through the trays 40 and 50, regardless of their location with respect to the patient on the operating table 11. In a less-preferred form, W1 and W2 may or may not be opaque and the major planar surface thereof formed of usual sheetform shelf, tray, or table material, such as wood, metal, or plastic such as polyethylene, polypropylene, or Formica® (phenolic or urea resin).

In conclusion, from the foregoing, it is apparent that the present invention provides a novel multi-adjustable surgical table for use in surgery, which enables the surgeon to adjust the same horizontally and vertically as desired, and to bring the fixed shelf or table portion thereof into any desired position with reference to a patient located on an operating table, and especially to position the depending table, shelf, or tray in any desired position with relation to the area of the operation being conducted, all with a minimum of inconvenience and minimum obstruction of the view of the surgeon, especially when the shelves or tables comprise a transparent sheetform material such as Plexiglas® or the like.

Thus, from the foregoing, it is seen that the present invention makes it possible effectively to provide a multi-adjustable surgical table, which may be used instead of the usual ether screen by the draping of appropriate material thereover as required, and which also serves as a multi-adjustable surgical table which provides the operating surgeon a convenient location for his tools and materials, both on the upper fixed tray and by adjusting and rigidly clamping the lower tray in any desired location with respect to the area of the operation, in any case optimally with a minimum of inconvenience and interference with the visual field below both trays.

It is to be understood that the invention is not to be limited to the exact details of operation, or to the exact materials, methods, procedures, or embodiments shown and described, as obvious modifications and equivalents will be apparent to one skilled in the art, and the invention is therefore to be limited only by the full scope which can be legally accorded to the appended claims.

I claim:

1. A multi-adjustable surgical table comprising the following elements:

a generally U-shaped major frame having essentially vertically-extending legs for releasable securement to a bed rail of an operating table;

a pair of bed rail clamps for adjustably and releasably securing said legs to said bed rail for both vertical and horizontal adjustment thereon;

a first shelf fixed in position between said essentially vertically-extending legs and extending outwardly therefrom in a plane essentially normal thereto so as to be essentially parallel to the plane of said operating table when said table is in place thereon;

a second outwardly-extending shelf pivotally connected by adjustable mounting and adjustment means to said first fixed outwardly-extending shelf;

said second shelf being adjustable vertically, horizontally, and rotatively, and being thereby placeable in any desired position with relation to said operating table.

2. The table of claim 1, wherein both shelves comprise a transparent sheetform material as a major planar segment thereof.

3. The table of claim 2, wherein said sheetform material is essentially unbreakable.

4. The table of claim 2, wherein said sheetform material is transparent plastic.

5. The table of claim 4, wherein said second shelf is pivotally connected to a frame of said first shelf.

6. The table of claim 2, wherein said sheetform material is transparent acrylic resin.

7. The table of claim 1, wherein said first and second shelves comprise a sheetform material as a major planar surface thereof which is held in place within an outer frame of said shelves by means of a generally U-shaped channel.

8. The table of claim 1, wherein said major frame comprises flat bar stock and said bed rail clamps comprise a correspondingly dimensioned rectangular aperture for adjustment of said vertical legs therein and a horizontal aperture for straddling said bed rail and means for releasably securing said clamps with included leg and bed rail portions in any desired position.

9. The table of claim 1, wherein said mounting and adjustment means comprises rods and clamp means, each clamp means comprising a bore for slidably receiving at least one of said rods and one of said clamp means comprising two bores for receiving two of said rods, each of said clamp means being provided with releasable securement means for securing said rods at any desired position within said bores, thus to enable said second shelf to be positioned at any desired location with respect to said operating table.

10. The apparatus of claim 1, wherein said mounting and adjustment means comprises a releasably-securable pivot and location first clamp means and a first rod releasably secured in an aperture therein, a second rod, a releasably-securable second and double clamp means releasably securing said first rod and said second rod therein, and a releasably-securable third clamp means rotatively and releasably securable to a frame of said second shelf and releasably securing an end of said second rod in an aperture therein, each of said clamp means releasably securing said rods but permitting vertical, horizontal, and rotative adjustment of the rod or rods releasably secured thereby.

11. The table of claim 10, wherein said releasably-securable second and double clamp means comprises split-ring clamp means and adjacent apertured block and U-grip clamp means and wherein said block and U-grip clamp means comprises draw bolt means which projects through said split-ring clamp means for tightening said split-ring clamp means simultaneously upon both rods.

12. The table of claim 10, wherein said pivot and location clamp means comprises means for releasably securing said pivot and location clamp means in any desired angular position and means for releasably securing said first rod in any position of rotation therein; wherein said double clamp means comprises split ring clamp means and a two-part U-grip clamp block means mounted for rotation with respect to said split ring clamp means, one of said split ring clamp means and said two-part U-grip clamp block means receiving said first rod and the other of said split ring clamp means and said two-part U-grip clamp block means receiving said second rod, and said two-part clamp block means comprising draw bolt means which projects through said split-ring clamp means for tightening said split ring clamp means and said two-part clamp means simultaneously on said first and second rods at any position to which adjusted angularly or rotatively; and wherein said third clamp means comprises split-block clamp means and means for tightening said split block clamp means about said second rod.

* * * * *

UNITED STATES PATENT AND TRADEMARK OFFICE

CERTIFICATE OF CORRECTION

PATENT NO. : 5,362,021

DATED : November 8, 1994

INVENTOR(S) : James L. Phillips

It is certified that error appears in the above-indentified patent and that said Letters Patent is hereby corrected as shown below:

Column 1, line 19; "sheet form" should read -- sheetform --

Column 1, line 67; "sheet form" should read -- sheetform --

Column 2, line 41; "sheet form" should read -- sheetform --

Column 2, line 43; "sheet form" should read -- sheetform --

Column 2, line 45; "sheet form" should read -- sheetform --

Column 2, line 47; "sheet form" should read -- sheetform --

Column 4, line 10; delete the word "after" and change "take" to --, taken --

Column 4, line 13; delete the word "after" and insert --,--.

Column 4, line 15; "10 or FIG. 13" should read -- 10 or FIG. 3 --

UNITED STATES PATENT AND TRADEMARK OFFICE

CERTIFICATE OF CORRECTION

PATENT NO. : 5,362,021

DATED : November 8, 1994

INVENTOR(S) : James L. Phillips

It is certified that error appears in the above-indentified patent and that said Letters Patent is hereby corrected as shown below:

Column 7, line 25; (Polycarbonate or resin) should read --polycarbonate resin --.

Column 8, line 54, "apparatus" should read --table --.

Signed and Sealed this

Tenth Day of January, 1995

Bruce Lehman

*Attest:*

BRUCE LEHMAN

*Attesting Officer*

*Commissioner of Patents and Trademarks*